US009444159B2

(12) United States Patent
Lappoehn et al.

(10) Patent No.: US 9,444,159 B2
(45) Date of Patent: Sep. 13, 2016

(54) TERMINAL FOR CONTACTING AN ELECTRICAL CONDUCTOR

(71) Applicant: ERNI Production GmbH & Co. KG, Adelberg (DE)

(72) Inventors: Juergen Lappoehn, Gammelshausen (DE); Stefan Molitor, Waeschenbeuren (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 14/906,944

(22) PCT Filed: Jul. 17, 2014

(86) PCT No.: PCT/DE2014/100263

§ 371 (c)(1),
(2) Date: Jan. 22, 2016

(87) PCT Pub. No.: WO2015/010689

PCT Pub. Date: Jan. 29, 2015

(65) Prior Publication Data

US 2016/0172771 A1 Jun. 16, 2016

(30) Foreign Application Priority Data

Jul. 24, 2013 (DE) ..... 10 2013 012 251

(51) Int. Cl.
*H01R 12/67* (2011.01)
*H01R 4/24* (2006.01)
(Continued)

(52) U.S. Cl.
CPC ..... *H01R 12/675* (2013.01); *H01R 4/2433* (2013.01); *H01R 4/2454* (2013.01); *H01R 4/5066* (2013.01); *H01R 12/515* (2013.01)

(58) Field of Classification Search
CPC ..... H01R 12/675
See application file for complete search history.

(56) References Cited

U.S. PATENT DOCUMENTS 3,388,370 A * 6/1968 Elm ..... H01R 4/24 439/402
3,808,582 A 4/1974 Aldridge et al.
4,033,661 A * 7/1977 Moody ..... H01R 4/2458 439/406

(Continued)

FOREIGN PATENT DOCUMENTS

DE 202 14 727 U1 2/2003
DE 102 22 324 A1 11/2003

(Continued)

OTHER PUBLICATIONS

International Search Report of PCT/DE2014/100263, mailed Oct. 24, 2014.

(Continued)

*Primary Examiner* — Ross Gushi
(74) *Attorney, Agent, or Firm* — Collard & Roe, P.C.

(57) ABSTRACT

A terminal (100) for contacting an electrical conductor (400) is characterized by an insulating housing (110) having an elongated opening (200) which is accessible from above for the insertion of the electrical conductor (400) and having at least one insulation displacement connector (210, 220) which is arranged laterally on the housing (110) and is able to move from the side and substantially perpendicularly to the elongated opening (120) and thereby contacts the electrical conductor (400) by insulation displacement connection and fixes it in the housing (110).

8 Claims, 9 Drawing Sheets

Figure 1:
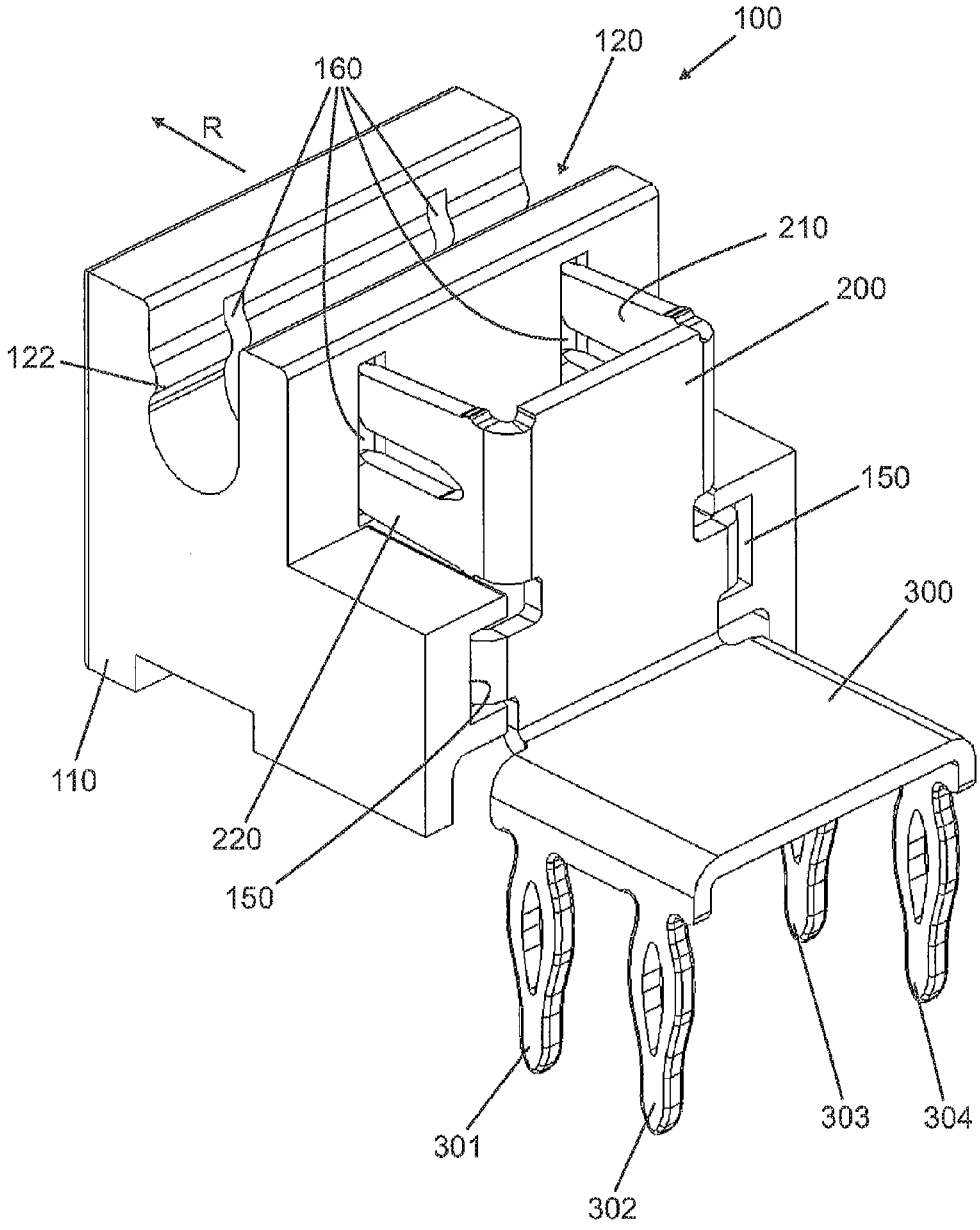

(51) Int. Cl.
*H01R 12/51* (2011.01)
*H01R 4/50* (2006.01)

(56) References Cited

U.S. PATENT DOCUMENTS 4,037,905 A * 7/1977 Lucas ..... H01R 4/2454 439/395
4,533,199 A * 8/1985 Feldberg ..... H01R 4/2433 29/838
4,668,039 A * 5/1987 Marzili ..... H01R 12/675 439/404
4,701,001 A * 10/1987 Verhoeven ..... H01R 9/053 439/394
5,549,484 A * 8/1996 Chen ..... H01R 12/515 439/404
5,890,924 A * 4/1999 Endo ..... H01R 4/2433 439/404
5,915,990 A * 6/1999 Beer ..... H01R 12/675 439/404
5,989,057 A * 11/1999 Gerke ..... H01R 4/2433 439/397
6,050,845 A * 4/2000 Smalley, Jr. ..... H01R 12/515 439/395
6,080,006 A * 6/2000 Broder ..... H01R 4/2433 439/409
6,135,804 A * 10/2000 Lux ..... H01R 4/2433 439/397
6,406,323 B2 * 6/2002 Chung Long Shan ..... H01R 4/2416 439/395
6,416,349 B1 * 7/2002 Lee ..... H01R 12/675 439/404
6,863,558 B2 * 3/2005 Negishi ..... H01R 4/2433 439/404
6,872,090 B2 * 3/2005 De Dios Martin .. H01R 4/2433 439/417
6,875,043 B2 * 4/2005 Turek ..... H01R 4/2454 439/397
6,955,557 B2 * 10/2005 Bernat ..... H01R 43/015 439/404
6,965,671 B2 * 11/2005 Kao ..... H01R 4/2429 379/438
7,101,216 B2 * 9/2006 Fasce ..... H01R 4/2433 439/402
7,114,985 B2 * 10/2006 Doorhy ..... H01R 4/2433 439/404
7,121,871 B2 * 10/2006 Duesterhoeft ..... H01R 4/4818 439/404
7,156,686 B1 * 1/2007 Sekela ..... H01R 12/675 439/403
7,156,687 B1 * 1/2007 Chiang ..... H01R 4/2429 439/400
7,156,688 B2 * 1/2007 Nakano ..... H01R 4/2433 439/417
7,201,601 B2 * 4/2007 Lappohn ..... H01R 4/2433 439/404
7,210,957 B2 * 5/2007 Mrakovich ..... F21S 4/10 439/404
7,270,564 B1 * 9/2007 Boischio ..... H01R 12/75 439/417
7,309,252 B2 * 12/2007 Fabian ..... H01R 4/2433 439/404
7,326,069 B1 * 2/2008 Duesterhoeft ..... H01R 4/2433 439/395
7,357,661 B2 * 4/2008 Yamamoto ..... H01R 4/2433 439/435
7,399,197 B2 * 7/2008 Fasce ..... H01R 4/2433 439/392
7,404,739 B2 * 7/2008 Sheilds ..... H01R 4/2441 439/290
7,503,797 B2 * 3/2009 Lappoehn ..... H01R 4/2433 439/404
7,540,760 B1 * 6/2009 Chen ..... H01R 4/2433 439/409
7,695,307 B2 * 4/2010 Mossner ..... H01R 4/2433 439/404
7,695,308 B2 * 4/2010 Allwood ..... H01R 4/2433 439/402
7,713,081 B2 * 5/2010 Chen ..... H01R 9/037 439/409
7,731,542 B2 * 6/2010 Doorhy ..... H01R 13/6463 439/456
7,833,045 B2 * 11/2010 Bishop ..... H01R 4/2429 439/404
7,955,116 B2 * 6/2011 Bishop ..... H01R 4/2429 439/404
7,976,334 B2 * 7/2011 Bishop ..... H01R 4/2433 439/395
8,109,783 B2 * 2/2012 Bishop ..... H01R 12/71 439/404
8,192,223 B2 * 6/2012 Bishop ..... H01R 4/2433 439/395
8,267,715 B2 * 9/2012 Roosdorp ..... H01R 4/2425 439/404
8,481,854 B2 * 7/2013 Zeng ..... H01R 4/2433 174/50
8,568,157 B2 * 10/2013 Bishop ..... H01R 4/2433 439/389
8,636,537 B2 * 1/2014 Kettern ..... H01R 13/506 439/389
8,672,703 B2 * 3/2014 Fehling ..... H01R 4/4836 439/417
8,714,992 B2 * 5/2014 Truemper ..... H01R 4/2433 439/275
8,714,996 B2 * 5/2014 Bishop ..... H01R 4/2433 439/397
8,740,638 B2 * 6/2014 Lappoehn ..... H01R 4/2433 439/397
8,814,590 B2 * 8/2014 Turco ..... F21V 21/002 439/419
8,840,424 B2 * 9/2014 Kudo ..... H01R 4/2429 439/417
8,979,572 B2 * 3/2015 Mochizuki ..... H01R 13/4223 439/417
9,184,514 B2 * 11/2015 Acera ..... H01R 4/2433
9,184,515 B1 * 11/2015 Freakes ..... H01R 4/28
9,246,241 B2 * 1/2016 Yamamoto ..... H01R 4/18
9,252,506 B2 * 2/2016 Acera ..... H01R 4/2416
9,293,840 B2 * 3/2016 Wasai ..... H01R 4/2429
2001/0016448 A1 * 8/2001 Daoud ..... H01R 4/2433 439/409
2003/0171023 A1 * 9/2003 Turek ..... H01R 4/2454 439/395
2003/0228775 A1 12/2003 Feye-Hohmann et al.
2006/0189174 A1 * 8/2006 Fabian ..... H01R 4/2433 439/66
2007/0254521 A1 11/2007 D'Agostini et al.
2008/0287006 A1 * 11/2008 Piovesan ..... H01R 4/2433 439/595
2009/0321131 A1 * 12/2009 Yamamoto ..... H01R 12/675 174/72 A
2012/0184150 A1 * 7/2012 Takasaki ..... H01R 4/2433 439/660
2012/0322294 A1 * 12/2012 Lappoehn ..... H01R 4/2433 439/397
2013/0252469 A1 * 9/2013 Mochizuki ..... H01R 4/2433 439/626
2015/0038002 A1 * 2/2015 Sabo ..... H01R 4/2433 439/395
2015/0038003 A1 * 2/2015 Sabo ..... H01R 4/2433 439/401
2015/0318636 A1 * 11/2015 Lappoehn ..... H01R 13/508 439/660
2015/0349451 A1 * 12/2015 Lappoehn ..... H01R 13/6272 439/660
2016/0172771 A1 * 6/2016 Lappoehn ..... H01R 4/2433 439/443

FOREIGN PATENT DOCUMENTS

DE 20 2004 020 191 U1 3/2005
DE 10 2009 060 521 A1 6/2011
DE 10 2010 033 545 A1 2/2012

(56) References Cited

FOREIGN PATENT DOCUMENTS

| | | | |
|---|---|---|---|
| EP | 1 291 984 | A1 | 3/2003 |
| EP | 2 500 981 | A1 | 9/2012 |
| EP | 2 634 862 | A1 | 9/2013 |
| FR | 2 832 554 | A1 | 5/2003 |

OTHER PUBLICATIONS

German Office Action in DE 10 2013 012 251.1, dated Apr. 9, 2014, with English translation of relevant parts.

* cited by examiner

TERMINAL FOR CONTACTING AN ELECTRICAL CONDUCTOR

CROSS REFERENCE TO RELATED APPLICATIONS

This application is the National Stage of PCT/DE2014/100263 filed on Jul. 17, 2014, which claims priority under 35 U.S.C. §119 of German Application No. 10 2013 012 251.1 filed on Jul. 24, 2013, the disclosure of which is incorporated by reference. The international application under PCT article 21(2) was not published in English.

The invention relates to a terminal for contacting an electrical conductor.

Terminals for contacting an electrical conductor or other electrical components are known extensively from prior art. Therefore, for example, DE 20 2004 020 191 U1 discloses an insertion contacting between a winding material, for example the coil of a transformer, and a circuit board by means of an insulation displacement connector. The insulation displacement connector, which is preferably provided with connector tabs, is inserted into a jumper which is electrically or mechanically fastened to a circuit board, whereby a secure electrical connection results using the elastic bending back of the connector tabs, as well as by mechanically piercing the connector tabs into the jumper.

A device for contacting electrical conductors having a housing and each having an insulation displacement connector emerges from DE 10 2010 033 545 A1. The insulation displacement connector is inserted into the housing.

A method for producing an electrical insulation displacement connector connection emerges from EP 1 291 984 A1.

Here, individual cables are inserted from above into an IDC connector (IDC=insulation displacement connection) and are contacted using a tool which exerts pressure from top to bottom in the vertical direction. The elastic connection of the contacts to the cables is hereby produced by pressing the cables into the insulation displacement connectors from top to bottom. The insulation material of the cables is thus pierced and displaced by the blades or flanks of the insulation displacement connectors and the exposed copper strands are permanently clamped by the spring effect of these flanks.

In all of these insulation displacement connector connections, the cables are each inserted from top to bottom into corresponding openings and are also contacted and fixed from top to bottom by exerting a joining force by means of insulation displacement connector technology.

A force is thereby exerted from top to bottom. Very often, the housings, plugs and similar in which the cables must be contacted are fastened to circuit boards such that the force is exerted on a circuit board, which is undesirable in many cases. Furthermore, since the insulation displacement connector contacting occurs in the same direction as the insertion of the cable, the risk exists that the cables can then be removed from the insulation displacement connector connection at least if a high tensile force is exerted on the cables, and therefore the electrical contacting is broken.

DISCLOSURE OF THE INVENTION

In contrast, the terminal according to the invention for contacting an electrical conductor having the features of claim 1 has the advantage that the electrical cable is able to be inserted from above into a housing, for which purpose the elongated opening is provided for the insertion of the electrical conductor, but the insulation displacement connector contacting occurs from the side and substantially perpendicularly to the elongated opening and to the insertion direction. In this way, no pressure is exerted, for example onto a circuit board on which the terminal is mounted during the insulation displacement connector contacting. The insulation displacement connector contacting can occur using a tong-like tool. This can, in particular, also occur automatically by means of a handling system, for example in a production line, such that the terminal according to the invention is easily available for automated production. Additionally, a secure holding of the electrical conductor is enabled by the insulation displacement connector contacting running transversely to the opening. In particular, the electrical conductor can no longer—not even with the exertion of a greater force—be pulled out of the elongated opening, as this is possible in the case of the electrical insulation displacement connector connections known from prior art. The terminal according to the invention therefore not only enables a simple and automated production, but also a secure and practically non-destructive fastening of a conductor fastened by means of insulation displacement connector contacting.

Advantageous developments and improvements of the terminal specified in independent claim 1 are possible using the measures listed in the dependent claims.

Therefore, an advantageous embodiment provides, for example, that at least two insulation displacement connectors are provided which are each positioned, seen in the conductor direction, at the front end and at the rear end of the elongated opening. Not only is the contacting hereby improved, but at the same time the electrical conductor is also particularly well fixed and therefore held in the elongated opening.

The two insulation displacement connectors are thereby preferably arranged on a U-shaped bracket and are able to move mutually with this, transversely to the opening in the direction of the electrical conductor, to form insulation displacement connector contacts. In this manner, a contacting and fastening of the electrical conductor in the elongated opening and therefore in the housing of the terminal is enabled with a single "tong movement".

The U-shaped bracket is advantageously connected to a connection element, which has contact elements for contacting with conductor tracks of a circuit board on its side facing away from the U-shaped bracket. In this way, a direct contacting of the electrical conductor with corresponding conductor tracks of a circuit board is possible.

It is particularly advantageous if the U-shaped bracket and the connection element are connected to each other in one piece.

The contact elements can be press-in contact elements; they can, however, also be formed as solder contact elements formed for surface soldering.

One advantageous embodiment provides that the connection element is a connection plate which is bent substantially at a right angle away from the U-shaped bracket, on lower sides of which, which face away from the U-shaped bracket, the contact elements are arranged. This enables a simple assembly and a particularly good contacting.

Advantageously it is provided that guides are provided in the housing for the U-shaped bracket having the insulation displacement connector contacts and the connection element, said guides enabling an insertion of the U-shaped bracket into the housing together with the insulation displacement connector contacts and with the connection element. If, in this case, the contact elements are already fastened, for example, to a circuit board, the housing is displaced in a reversed manner relative to the U-shaped bracket, wherein in turn the insulation displacement connector contacts penetrate the conductor and thereby the insulation material of the conductor is pierced and displaced by the blades or flanks of the insulation displacement connectors and the exposed copper strands are permanently clamped by the spring effect of these flanks.

It is particularly preferably provided that the elongated opening has a tapering in the opening direction, which serves to firmly clamp an electrical conductor to be inserted. In this way, the conductor is already firmly held in the elongated opening even before the insulation displacement connector contacting has occurred. This tapering also proves to be particularly advantageous during the insulation displacement connector contacting.

The housing preferably consists of a plastic.

SHORT DESCRIPTION OF THE DRAWINGS

Exemplary embodiments of the invention are depicted in the drawings and explained in more detail in the following description.

Figure 2:
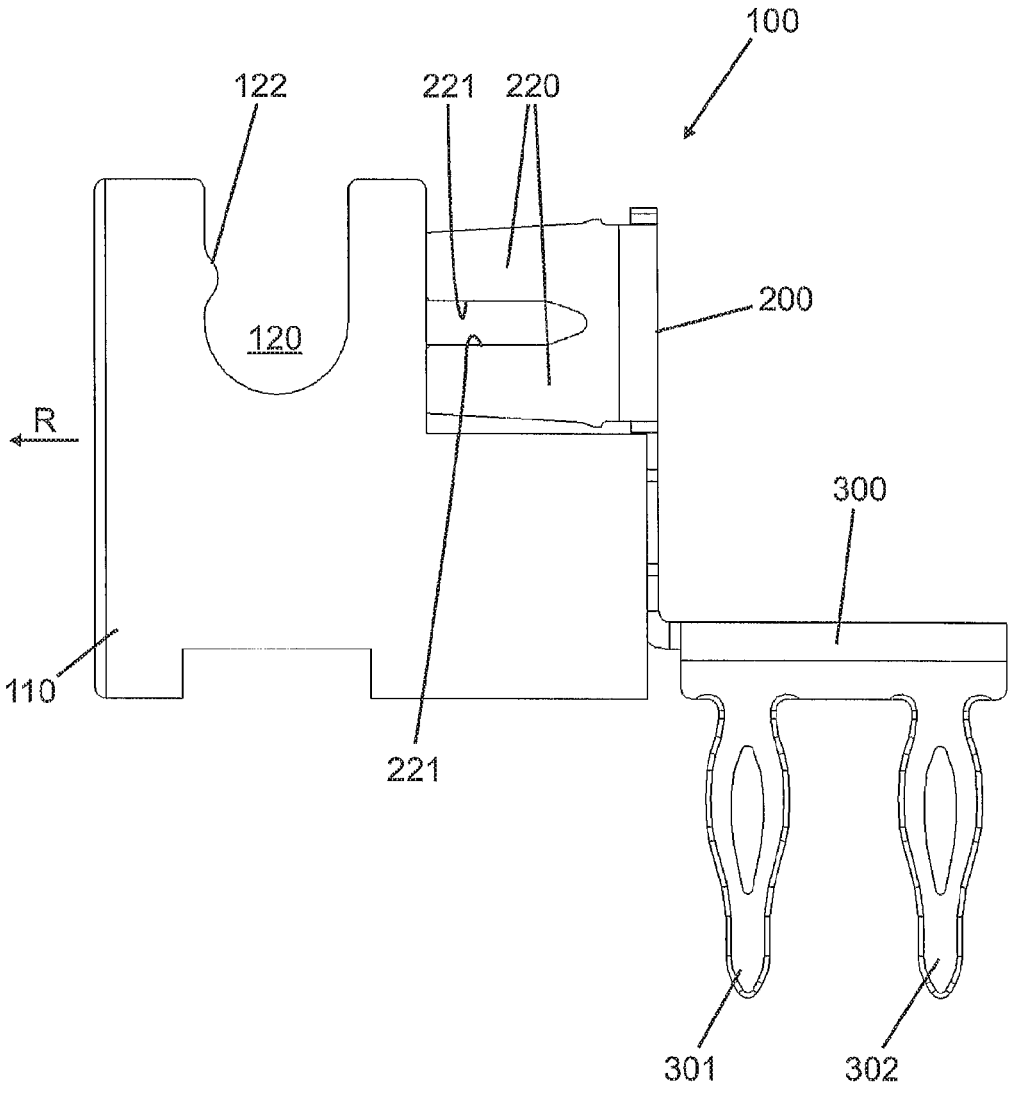
Figure 3:
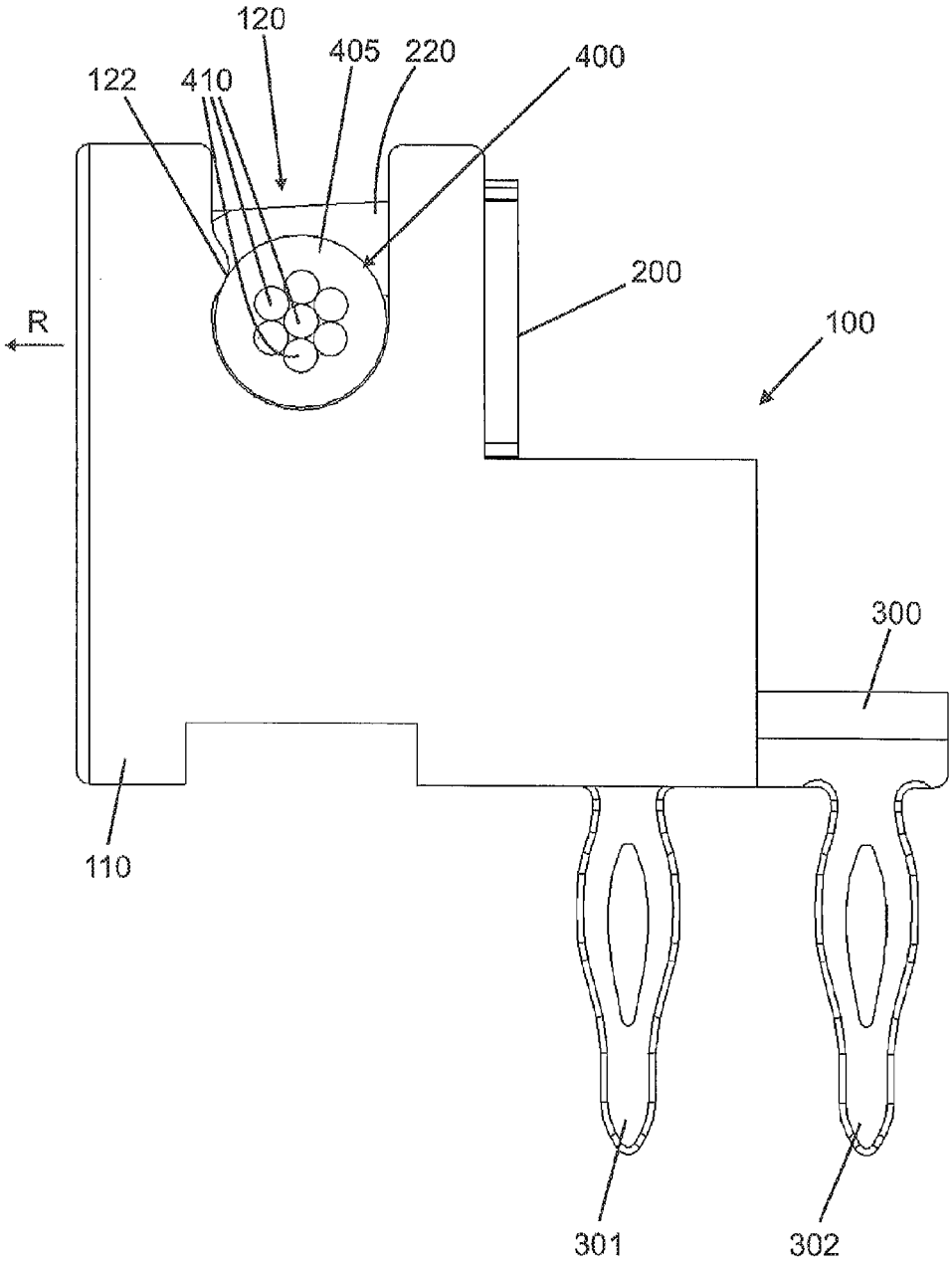
Figure 4:
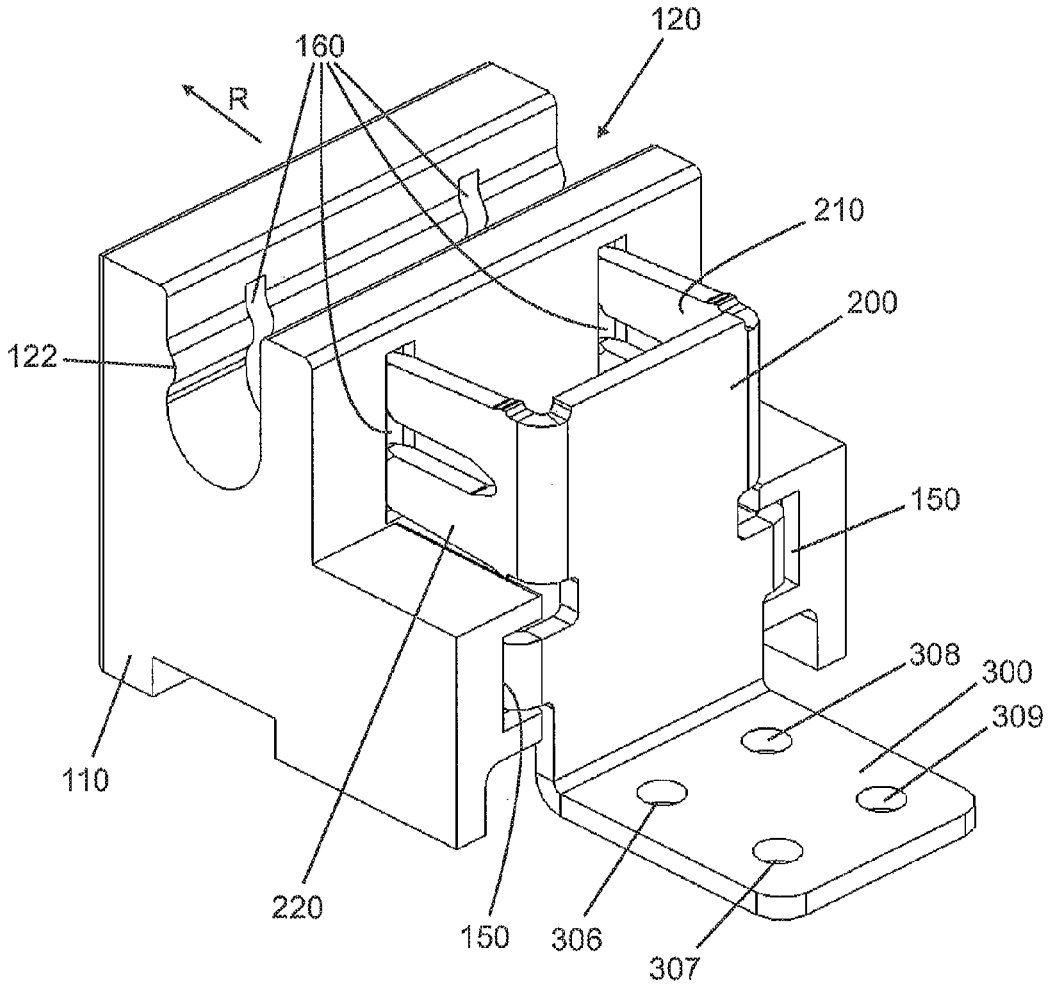
Figure 5A:
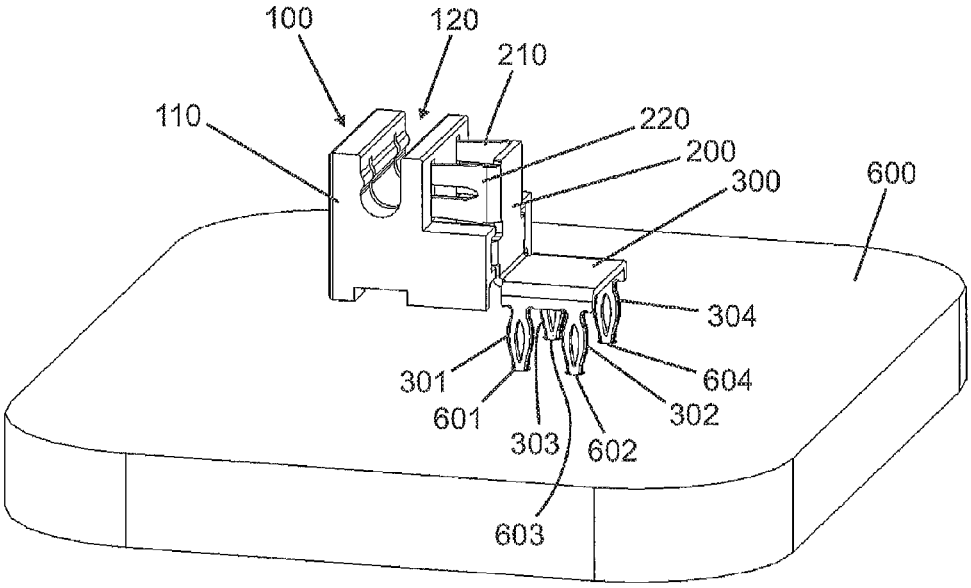
Figure 5B:
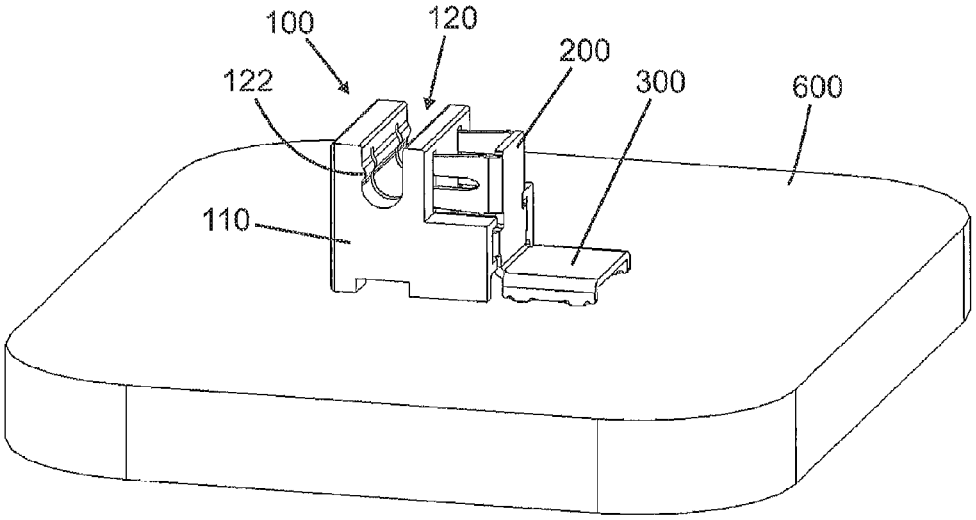
Figure 5C:
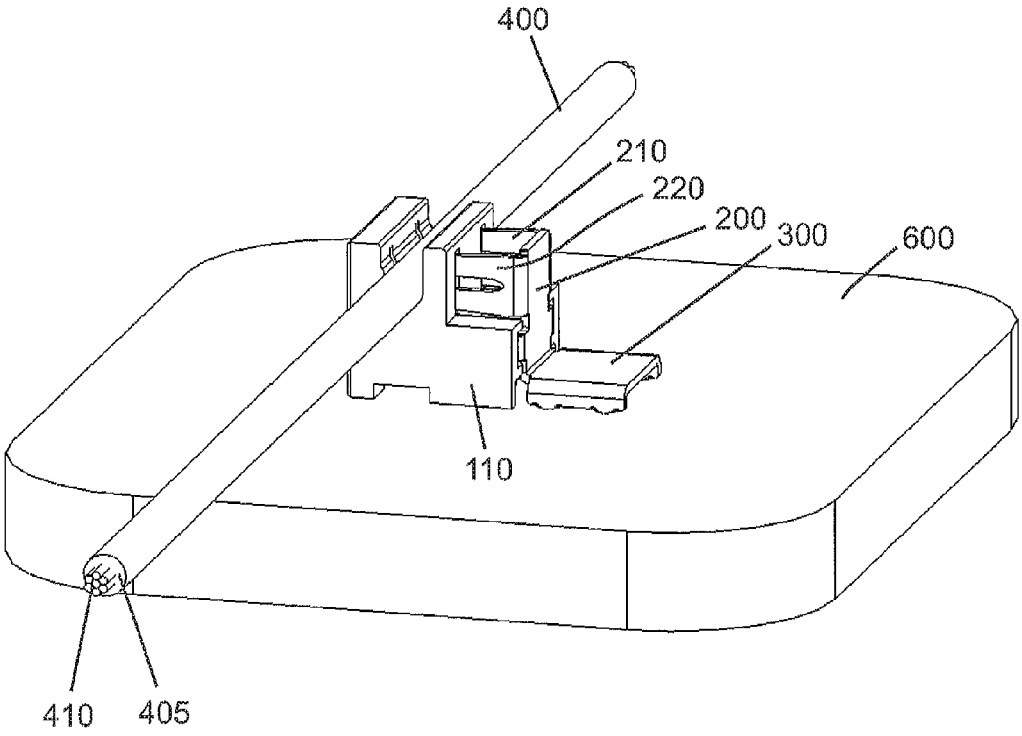
Figure 5D:
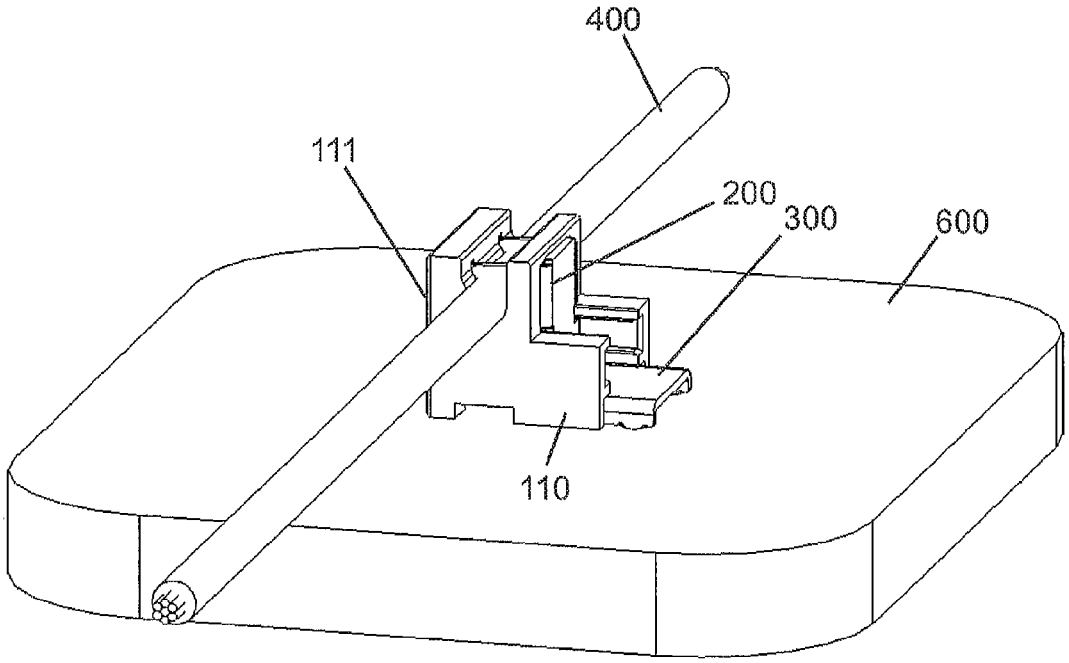
Figure 6:
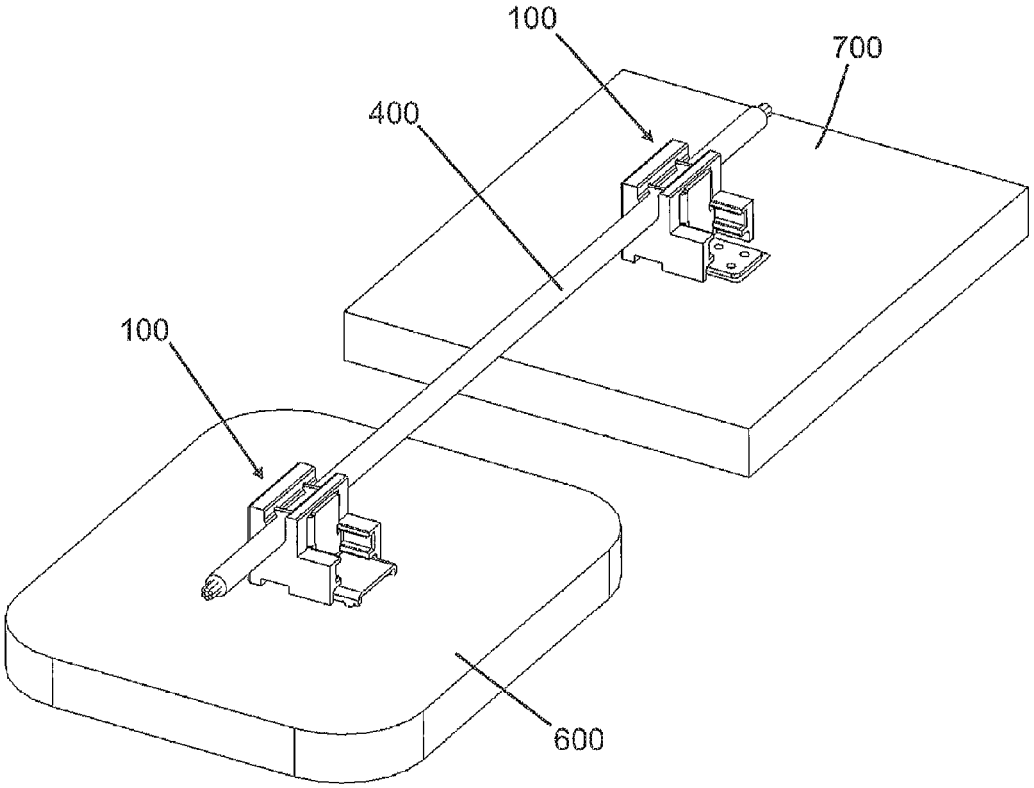

Here are shown:

FIG. 1 an isometric depiction of a terminal according to the invention;

FIG. 2 a side view of the terminal according to the invention depicted in FIG. 1, before an electrical conductor has been inserted and contacted;

FIG. 3 the side view according to the FIG. 2, after an electrical conductor has been inserted into the terminal and contacted;

FIG. 4 a different embodiment of a terminal according to the invention;

FIG. 5*a-d* different assembly steps which show the fastening of a terminal according to the invention to a circuit board and the subsequent contacting of an electrical conductor in the terminal and FIG. 6 the connection of two circuit boards with the aid of a conductor, which has been fastened to the circuit boards by means of terminals according to the invention and contacted.

EMBODIMENTS OF THE INVENTION

A terminal, which is referred to as a whole with 100, has a housing 110 which consists, for example, of plastic. An elongated opening 120 which is accessible from above is provided in this housing, said elongated opening 120 having a tapering 122. A U-shaped bracket 200 is arranged laterally on the housing, on which U-shaped bracket 200 insulation displacement connectors 210 and 220 are arranged respectively. A connection element 300 is connected in one piece to the U-shaped bracket 200. This connection element 300 has, for example, press-in contacts 301, 302, 303 and 304. These press-in contacts serve for the pressing into corresponding openings on a circuit board for example (see FIG. 5*a* to *c*, FIG. 6). As can furthermore be gleaned from FIG. 1, guides 150 and 160 for the U-shaped bracket 200 and the insulation displacement connector contacts 210, 220 are provided in the housing 110 which enable a lateral insertion of the insulation displacement connector contacts into the housing along a direction which is depicted in the figures with an arrow R. As, in particular, can be gleaned from FIG. 2, the insulation displacement connector contacts 220 have a fork-shaped design having insulation displacement flanks 221 which pierce and displace the insulation material 405 of a conductor 400 and likewise partially pierce the exposed copper strands 410 or at least clamp the two blades of the insulation displacement connector 220 due to the spring effect. This is depicted schematically in FIG. 3 which shows the contacted and fastened state of an electrical conductor in the terminal 100. In FIG. 3, additionally it can be particularly well recognised how the protrusion 122 holds the electrical conductor in a position which is favourable for the insulation displacement connector contacting and in particular secures it from falling out of the elongated opening 120. After the electrical conductor has been contacted and fastened in this way, which can occur, for example, by means of corresponding tongs which exert a force on the U-shaped element 200 and the housing 110 and in this way, an insertion of the insulation displacement connectors 210, 220 emerges, simultaneously contacting and fixing the electrical conductor in the housing.

In FIG. 4, another embodiment of a terminal according to the invention is depicted which differs from that depicted in FIGS. 1 to 3 by the type of contacting on a circuit board. Instead of press contacts, corresponding openings 306, 307, 308, 309 are provided here to receive solder, by means of which the connection element 300 is able to be fastened to a circuit board by surface soldering. Incidentally, the same elements are depicted in FIG. 4 with the same reference numerals as in FIGS. 1 to 3, such that reference is made to the statements regarding these elements above.

The fastening of the terminal to the circuit boards and the contacting and fastening of a conductor is explained below in connection with FIGS. 5*a-d* and 6.

Firstly, a terminal 100 is fastened to a circuit board 600. For this purpose, openings 601, 602, 603, 604 are provided in the circuit board 600 which enable a pressing in of the press-in contacts 301, 302, 303, 304 (see FIG. 5*a*). After the terminal 100 has been fastened to the circuit board 600 in this way (FIG. 5*b*), an electrical conductor 400 is inserted into the elongated opening 12 of the terminal and is held there due to the tapering 122 (FIG. 5*c*). Then the insulation displacement connector contacting is produced by lateral insertion of the insulation displacement connectors 210, 220 by means of a (not depicted) tong-like tool. A force is exerted on the U-shaped bracket 200 and on the housing side 111 of the housing 110 lying opposite it by the tong-like movement. In this way, the conductor 400 is contacted and fastened in the terminal 100. FIG. 6 shows the connection of two circuit boards 600 and 700, on each of which terminals are arranged, wherein the terminal arranged on the circuit board 600 is a terminal having press-in contacts, whilst the terminal arranged on the circuit board 700 represents a terminal having SMD solder contacts. The conductor 400 can connect the two circuit boards 600, 700.

The advantage of the terminal 100 described above is that it is also available for automated production. The pressure for contacting is thereby not exerted on the circuit board 600, 700, but in a tong-like manner on the housing 110 and the U-shaped bracket 200. This lateral exertion of pressure has the great advantage that it is better available for automated production. Additionally, damage of the circuit board is excluded. The lateral contacting additionally enables a substantially more secure holding of the conductor 400 in the housing 110 of the terminal 100. The conductor 400 is "locked in place" to an extent in the terminal 100 by the two insulation displacement connectors, which are arranged at the front and at the rear end of the elongated opening 120, running transversely to the opening and therefore holding the conductor 400 practically unreleasably in the terminal 100.

The invention claimed is:

1. Terminal (100) to contact an electrical conductor (400), having an insulating housing (110) having an elongated opening (120) which is accessible from above to insert the electrical conductor (400) and having at least one insulation displacement connector (210, 220) which is arranged laterally on the housing (110) and is able to move from the side and substantially perpendicularly to the elongated opening (120) and thereby contacts the electrical conductor (400) using the insulation displacement connection and fixes it in the housing (110), wherein at least two insulation displacement connectors (210, 220) are provided which are each positioned, seen in the conductor direction, at the front and rear end of the elongated opening (120), and wherein the two insulation displacement connectors (210, 220) are arranged on a U-shaped bracket (200) and are able to move mutually, transversely to the opening in the direction of the electrical conductor (400), to form insulation displacement connector contacts, wherein the U-shaped bracket (200) is connected to a connection element (300) which has contact elements (301, 302, 303, 304, 306, 307, 308, 309) for contacting with conductor tracks of a circuit board (500, 600).

2. Terminal (100) according to claim 1, wherein the U-shaped bracket (200) and the connection element (300) are connected to each other in one piece.

3. Terminal (100) according to claim 1, wherein the contact elements are press-in contact elements (301, 302, 303, 304).

4. Terminal (100) according to claim 1, wherein the contact elements are solder contact elements (306, 307, 308, 309) formed for surface soldering.

5. Terminal (100) according to claim 1, wherein the connection element (300) is a connection plate which is bent substantially at a right angle away from the U-shaped bracket, on the lower sides of which, which face way from the U-shaped bracket (200), the contact elements (301, 302, 303, 304, 306, 307, 308, 309) are arranged.

6. Terminal (100) according to claim 1, wherein guides (150, 160) are provided for the U-shaped bracket (200) having the insulation displacement connector contacts (210, 22) and the connection element (300) in the housing (110), said guides (150, 160) enabling an insertion of the U-shaped bracket (200) having the insulation displacement connector contacts (210, 220) and the connection element (300) into the housing.

7. Terminal (100) according to claim 1, wherein the elongated opening (120) which is accessible from above has a tapering (122) in the opening direction to firmly clamp an electrical conductor (400) to be inserted.

8. Terminal (100) according to claim 1, wherein the housing (110) comprises plastic.

* * * * *